United States Patent [19]

Filewich

[11] Patent Number: 4,666,139

[45] Date of Patent: May 19, 1987

[54] VACUUM SYSTEM FOR COMBINATION FOLD-OFF CONTROL

[75] Inventor: Paul T. Filewich, North Stonington, Conn.

[73] Assignee: Harris Graphics Corporation, Melbourne, Fla.

[21] Appl. No.: 789,503

[22] Filed: Oct. 21, 1985

[51] Int. Cl.[4] ..... B65H 39/02

[52] U.S. Cl. ..... 270/54; 493/432

[58] Field of Search ..... 270/20.1, 54, 55, 57–58; 493/432, 442, 418, 450; 271/112

[56] References Cited

U.S. PATENT DOCUMENTS

| | | | |
|---|---|---|---|
| 1,974,149 | 9/1934 | Christman | 493/418 X |
| 3,506,255 | 4/1970 | Jahn et al. | 493/418 |
| 3,572,683 | 3/1971 | Hepp | 270/54 |
| 3,870,292 | 3/1975 | Bradley | 493/418 X |
| 4,082,259 | 4/1978 | Anderson | 493/450 |
| 4,494,949 | 1/1985 | Baley | 493/442 X |
| 4,521,209 | 6/1985 | DuFresne | 493/450 |

*Primary Examiner*—E. H. Eickholt

*Attorney, Agent, or Firm*—Tarolli, Sundheim & Covell

[57] ABSTRACT

A signature folder is disclosed in which a vacuum system is provided to prevent tail whipping of the signature when the direction of movement thereof is reversed. The folder provides two counter-rotating cylinders. A portion of the signature moves along the periphery of one cylinder and then reverses direction to move onto the periphery of the other cylinder. A vacuum system is provided adjacent to the signature when it reverses direction. The vacuum system includes a pair of guides and a central, freely rotatable vacuum roll. The vacuum causes the reversing portion of the signature to move into engagement with the guides and roll and eliminates tail whipping. Further, it guides the signature so that it smoothly moves onto the periphery of the subsequent roll.

7 Claims, 11 Drawing Figures

VACUUM SYSTEM FOR COMBINATION FOLD-OFF CONTROL

BACKGROUND OF THE INVENTION

This invention relates generally to signature folders for publication presses and the like, and more particularly to a novel and improved system for preventing tail whipping when the direction of movement of a portion of signature is reversed.

PRIOR ART

Signature folders for publication presses and the like are well known. Such folders often provide a pair of counter-rotating cylinders which define a nip or throat through which the signatures pass during the folding operation. Gripping means are provided which grip the signature at spaced locations and cause the intermediate signature portion between such locations to move first along the periphery of one cylinder and then reverse directions and move along the periphery of the other cylinder.

This reversal in direction of movement often creates problems of tail whipping that can tear or otherwise damage the signatures. Such problem tends to be aggravated as the speed of operation of the folder is increased. Guides have sometimes been provided in an attempt to reduce such tail whipping, but they are only partially effective, and the problem continues to exist particularly in folders which operate at high speeds.

SUMMARY OF THE INVENTION

With the present invention, the problem of tail whipping in signature folders is virtually eliminated, even when the folder operates at high speeds.

In accordance with the present invention, a vacuum is provided along one side of a signature tail as the reversal of direction occurs. Such vacuum removes the air cushion along one side of the signature tail and the pressure along the other side of the signature tail tends to press the signature tail over against a perforated vacuum roll. This prevents the initial whipping action.

As the signature moves in the reverse direction, it is carried over the freely rotating vacuum roll which provides sufficient drag to ensure that the signature tail remains smooth, and subsequently smoothly feeds onto the cylinder periphery.

In the illustrated embodiment of this invention, the vacuum roll is journaled within the zone between the two cylinders and below the throat. Such roll is freely journaled on bearings for rotation about an axis parallel to the axis of rotation of the two cylinders. Also provided are guides which extend from the roll in substantially a tangential manner with respect to the roll and in closely spaced relationship to the peripheries of the two cylinders. Because the area between the guides and the rollers is relatively closed, the vacuum supplied to the roll tends to evacuate the air cushion between the cylinders and the roll. As the signature is positioned between each of the cylinders and the adjacent guides, the vacuum tends to pull the signature over against the guides, reducing the tendency for the signature to whip during direction reversals.

The roll is not driven in the illustrated embodiment, but is rotated by its contact with the signature as the signature is pulled along the surface of the roll. Such roll and guides provide a light friction-induced drag on the signature, which tends to keep the signature smooth as it feeds across the roll onto the subsequent cylinder.

These and other aspects of this invention are illustrated in the accompanying drawings, and are more fully described in the following specification.

DETAILED DESCRIPTION OF THE DRAWINGS

Figure 1:
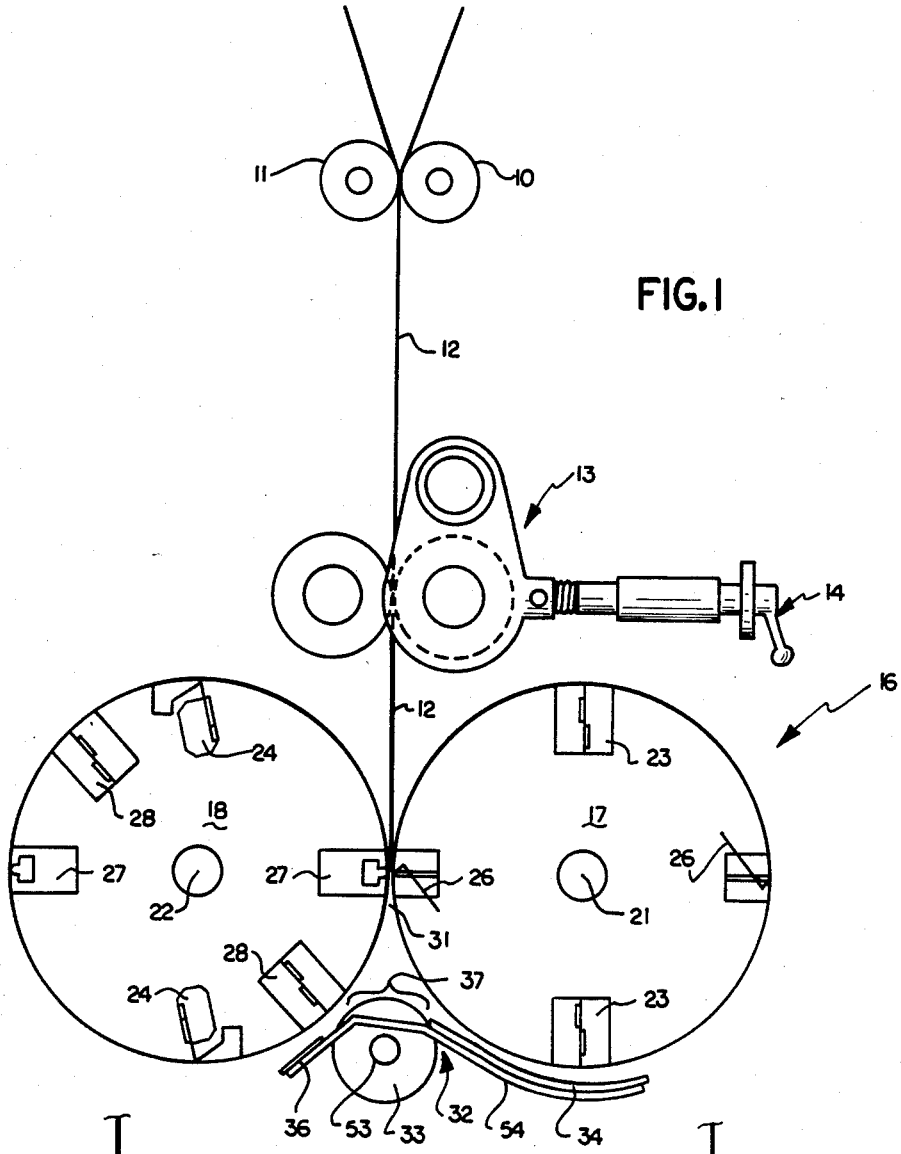
FIG. 1 is a schematic side elevation of a signature folder incorporating a vacuum roll system in accordance with the present invention.
Figure 2A:
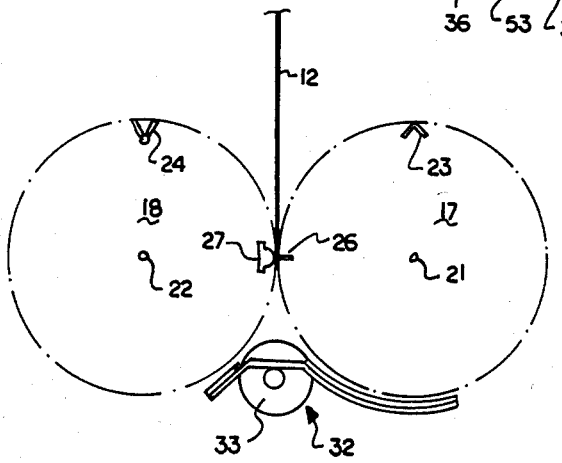
FIG. 2*a* schematically illustrates the system when the leading edge of a signature enters the throat between the cylinders and is gripped by impaling pins on one cylinder.
Figure 2B:
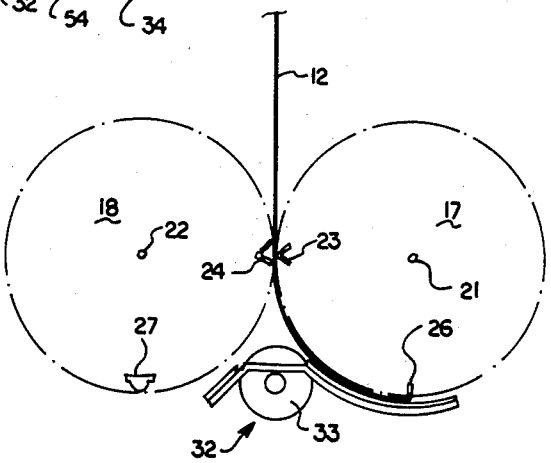
FIG. 2*b* is a view similar to FIG. 2*a* but illustrates the condition which exists after the first half of the signature has been moved through the throat and onto the periphery of the first or forward cylinder. In such position, a central portion of the signature is tucked into fold jaws on the second cylinder by a tucker blade carried by the first cylinder.
Figure 2C:
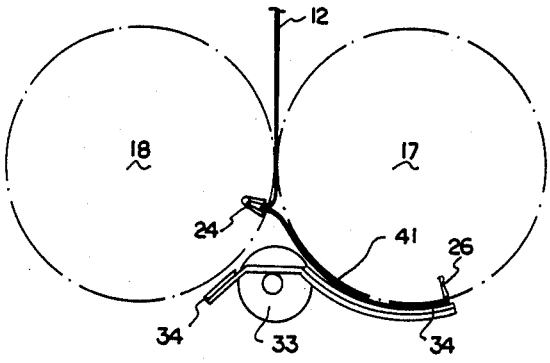
FIG. 2*c* is a view similar to FIGS. 2*a* and 2*b*, but illustrates the folder in a position in which the portion of the signature extending along the periphery of the first cylinder reverses in direction and commences to move in the opposite direction so that it can be positioned along the periphery of the second cylinder.
Figure 2D:
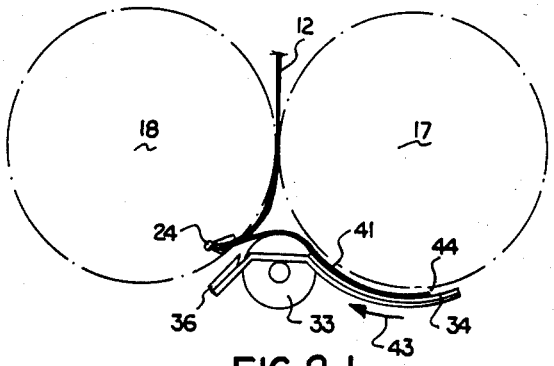
FIG. 2*d* is similar to the preceding three figures, but illustrates the system at a position in which the signature engages the vacuum roll and commences feeding onto the periphery of the cylinder.
Figure 2E:
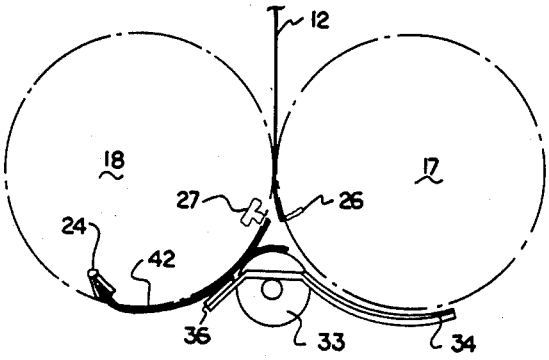
FIG. 2*e* is a view similar to the preceding schematic FIGS. 2*a* through 2*d*, but illustrates the condition when the signature is substantially completely wrapped along the periphery of the second cylinder.
Figure 2F:
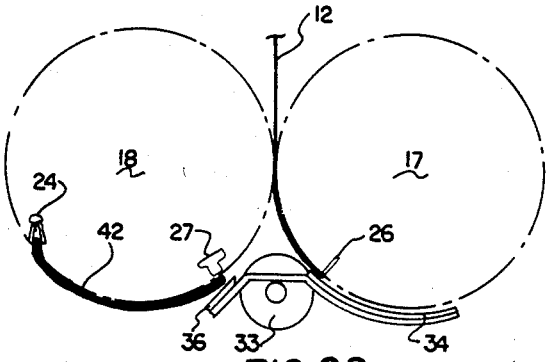
FIG. 2*f* is similar to FIGS. 2*a* through 2*e*, but illustrates the condition when the signature is leaving the vacuum system.

The present invention is illustrated as applied to a typical signature folder, a portion of which is schematically illustrated in FIG. 1. In such folder, the signature feeds down along a former board and between a pair of rolls 10 and 11 below the former. In such portion of the folder, the signature 12 is in the form of a continuous web. Below the rolls 10 and 11 is a pinch roll station 13. The pinch rolls are adjustable by a hand wheel 14. From the pinch roll station, the continuous web signature 12 continues to a folding station 16, at which two counter-rotating cylinders 17 and 18 are located. The first cylinder 17 is journaled for anti-clockwise rotation around a pivot axis 21 and the second cylinder 18 is journaled for clockwise rotation about its pivot axis 22.

Various signature gripping and cutting mechanisms are carried by the first and second cylinders. These mechanisms are schematically illustrated in FIG. 1. For example, tucker blades 23 are mounted on the first cylinder which cooperate with fold jaws 24 on the second cylinder 18 in the manner described in greater detail below. Similarly, impaling pins 26 on the first cylinder 17 cooperate with a female cutting iron or cutting rubber 27 on the second cylinder 18 to separate the preceding signature passing between the cylinders 17 and 18 from the continuous web 12 and to grip the leading edge of the web so that it will be carried by the impaling pins 26 along the surface of the first cylinder 17. The second cylinder 18 is illustrated as provided with tucker blades 28 which cooperate with folding jaws on a subsequent or third cylinder (not illustrated).

The structure described thus far is conventional structure, and forms no part of the present invention except as it cooperates with the vacuum mechanism to reduce or eliminate any tail whipping and the like. It has not been illustrated or discussed in greater detail because it is well known to those skilled in the art.

Mounted below the throat 31 through which the signatures pass into the folding station 16 is a vacuum roller assembly 32. Such assembly 32 functions to prevent the tail whipping in accordance with the present invention and smoothly feeds portions of the signature from the periphery of the first cylinder 17 onto the second cylinder 18.

The vacuum roller assembly 32 includes a vacuum roll 33 and a guide system, including a first guide portion 34 extending along the periphery of the first cylinder 17 and a second guide portion 36 extending along the periphery of the second cylinder 18.

The particular structure of the illustrated embodiment of the vacuum roll assembly is discussed in greater detail below; however, its general operation and the manner in which it prevents tail whipping and promotes smooth feeding will be discussed first.

The vacuum roll 33 is structured, as discussed below, so that it produces a vacuum zone indicated within the bracket 37 along the upper surface of the roll between the two guide portions 34 and 36. Also, this vacuum tends to produce zones of low pressure along the two guide portions 34 and 36.

In operation, the leading edge of the signature web 12 is pressed onto the impaling pins 26 of the cylinder 17 when the condition of FIG. *2a* is reached. As the two cylinders counter-rotate about their respective axes 21 and 22, the leading edge of the web 12 is carried by the impaling pins 26 along the periphery of the first cylinder 17 to a position illustrated in FIG. *2b* which is displaced from the position of FIG. *2a* by 90 degrees of rotation of the two cylinders 17 and 18. In such position, one-half of the signature is positioned along the periphery of the first cylinder 17 and the tucker blades 23 on the first cylinder 17 are in alignment with the associated first fold jaw 24 on the second cylinder 18. These cooperate to cause the signature web 12 to be gripped by the first fold jaws 24 so that the remaining portion of the signature will be carried along the periphery of the second cylinder 18 and not the first cylinder 17.

This is best illustrated in FIG. *2c*, which illustrates the position in which the first fold jaws 24 on the second cylinder 18 are commencing to carry the remaining portion of the signature along the periphery of the second cylinder 18. At about this position, the first portion or leading half of the signature 41 has moved along the periphery of the cylinder 17 to about its maximum extent. At this time, the impaling pins 26, which grip the forward edge of the signature, are withdrawn, releasing the signature from the first cylinder so that it can move from the first cylinder 17 onto the periphery of the second cylinder 18, as progressively illustrated in FIGS. *2d*, *2e*, and *2f*.

When the two cylinders 17 and 18 have rotated through 180 degrees from the position of FIG. *2a*, an associated subsequent impaling pin cutter iron 27 operates to cut a completed signature 42 from the signature web 12 and the leading edge of the web 12 is carried by the impaling pins 26 along the periphery of the first cylinder 17 to repeat the cycle of operation. The commencement of this operation is illustrated in FIG. *2e*.

At about the point in the cycle of operation illustrated in FIG. *2c*, the direction of the first half 41 of the signature 42 reverses its direction of movement. Up until such point in the cycle, the first half 41 of the signature has been moving in a direction to the right, as viewed in the drawings. However, immediately thereafter, the direction of movement of the first half 41 of the signature 42 must reverse and move in the direction indicated by the arrow 43 in FIG. *2d*. Such reversed direction movement continues through the condition of FIG. *2e* and FIG. *2f* until the entire signature 42 extends along the periphery of the second cylinder 18, as illustrated in FIG. *2f*.

The operation and movement of the signature thus far described are substantially conventional, and exist in prior art machines. However, in such prior art machines, the tail 44 of the signature half 41 tends to snap or whip in a violent manner much the same as when a towel is snapped. This often produces tears or damage in the signature half. Also, the violence of this whipping action prevents the signature half from smoothly feeding onto the second cylinder 18.

The tail whipping of the prior art, however, is eliminated by the present invention because a vacuum exists between the roll 33 and such first half of signature 41. This tends to remove the air from one side of the signature half, which would otherwise suspend such signature half and create a condition which allows the tail 44 to whip upon direction reversal. Further, geometry tends to produce a condition in which the signature half moves into engagement with the guide 34 and into engagement with the roll 33, as illustrated in FIG. *2d*. Therefore, not only is the whipping of the signature prevented, but a light drag is provided against the signature half 41 which causes it to move smoothly from the position of FIG. *2d* to the position of FIG. *2f*, when it is located against the periphery of the second cylinder 18.

The roller 33 itself is freely rotating so that excessive drag is not created on the signature half as the signature half moves along the surface of the roller.

Figure 3:
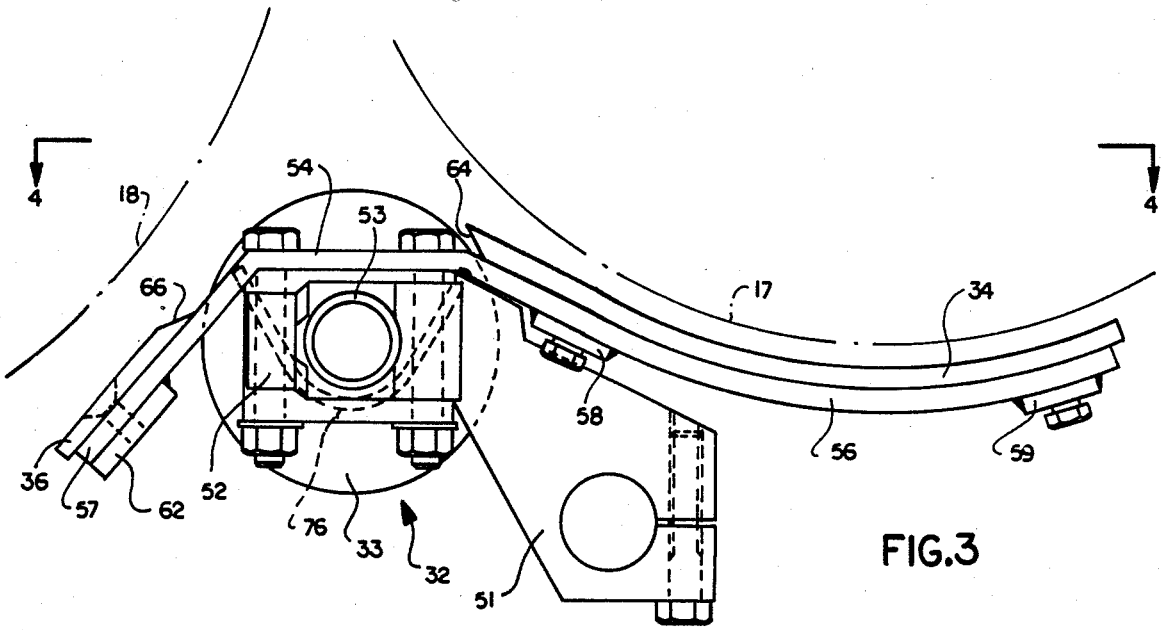
FIG. 3 is an enlarged, fragmentary, side elevation of the vacuum system.
Figure 4:
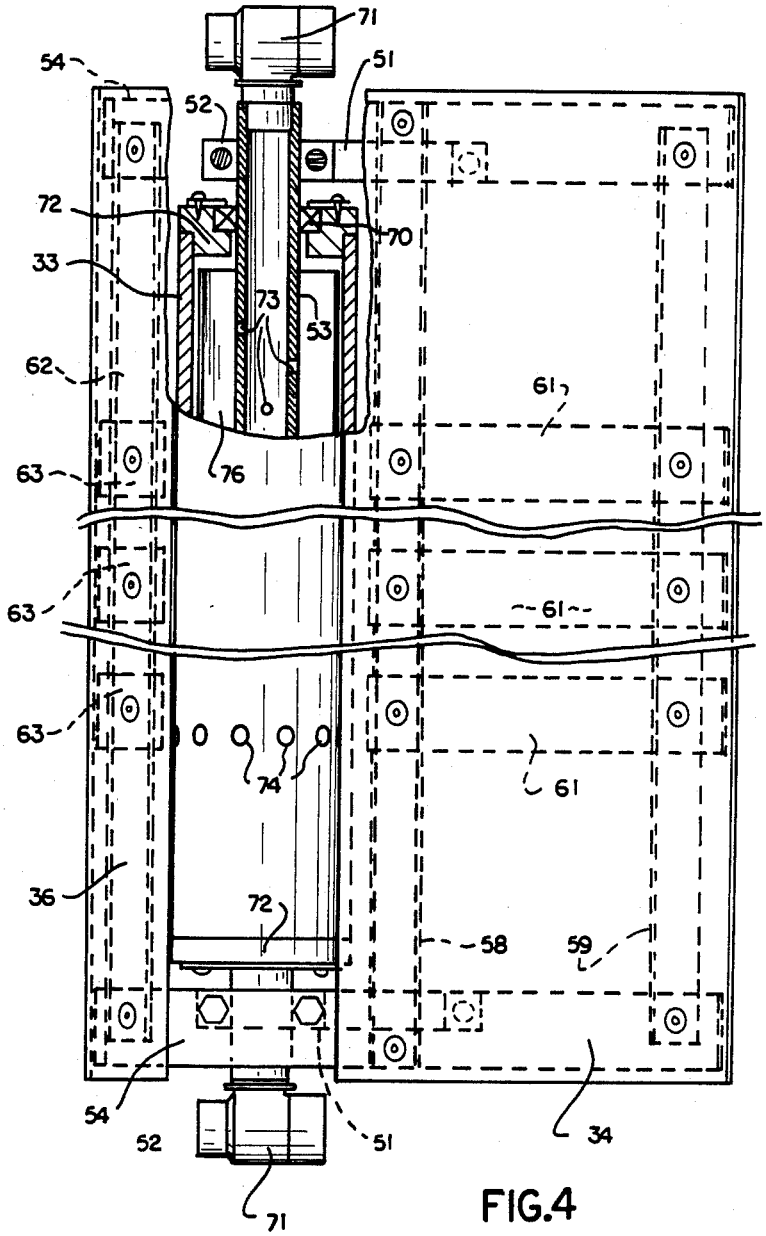
FIG. 4 is a plan view of the vacuum system.

The structure of the vacuum roller assembly 23 is best illustrated in FIGS. 3 and 4. The assembly 32 is supported by spaced frame members 51 mounted on portions of the folder frame (not illustrated). Such frame members 51 provide a clamping structure 52 which clamps onto a vacuum tube 53 substantially adjacent to each end thereof. Such clamping structure also provides the mounting for a guide support 54 adjacent to each end of the tube. The guide supports are pieces of strap material shaped to provide a first curved portion 56 which extends along the first guide portion 34 and a second support portion 57 which extends along the underside of the second guide portion 36.

Longitudinally extending bars 58 and 59 extend between the supports 54 so that additional support members 61 may be provided at intervals along the length of the guide portion 34. Similarly, a bar 62 extends between the supports 54 so that intermediate supports 63 are provided along the length of the guide portion 36. Preferably, the two guide portions 34 and 36 are formed of plastic or other sheet material and are provided with a smooth finish. Further, the trailing edge 64 of the guide portion 34 is preferably beveled, as illustrated in FIG. 3, so that the signature moves smoothly from such guide surface to the roll 33. Similarly, the leading edge 66 of the guide portion 36 is beveled so that the signature can move smoothly from the roll 33 onto the surface of the guide portion 36.

Vacuum fittings 71 are provided at each end of the tube 53 and are connected to a source of vacuum (not illustrated). The roll 33 is a tubular member (as best illustrated in FIG. 4) which is mounted on end plates 72, which are in turn journaled by bearings 70 on the tube 53. Therefore, the roll 33 is freely rotatable about the the tube 53. A section along the top of the tube within the roll is removed so that the vacuum therein can draw air from the interior of the roll 34 into the tube for evacuation through the tube ends to the vacuum source. Similarly, specially configured ports 74 as described below are provided at intervals along the length of the roll 33 so that air can be drawn into the interior of the roll by the vacuum existing therein. A generally semicylindrical deflector 76 is mounted on the tube 53 within the roll 33 so as to concentrate the effect of the vacuum along the upper side of the roll 33 along which the signature half 41 moves during the operation of the folder.

Figure 5:
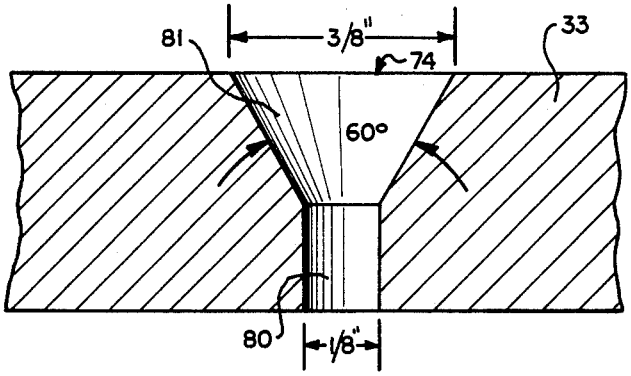
FIG. 5 is a cross sectional view of a vacuum opening in the periphery of the vacuum roll in the embodiment of FIG. 1.

One of the ports 74 is shown in FIG. 5. Each port 74 is designed so as to reduce flow and concentrate the vacuum at the surface of the roll 33. Specifically, each port 74 has a cylindrical passage portion 80 communicating with the interior of the roll 33. The passage portion 80 communicates with a converging passage portion 81 which intersects the outer surface of the roll 33. It has been found that the angle shown in FIG. 5 between the converging walls of the portion 80 should be approximately 60°, that the diameter of the portion 80 of the port 74 should be approximately $\frac{1}{8}''$, and the diameter of the portion 81 at the roll surface should be $\frac{3}{8}''$. Obviously, other dimensions of the port 74 could probably be developed but the above noted dimensions have been found to be particularly advantageous. Further, it should be clear that the portion 81 in plan view would be an oval configuration on the surface of the roll in view of the fact that portion 81 is formed by engaging the roll with a tapered type drill which forms a circular opening but, in of the curvature of the roll in plan view of the opening 81 would be oval.

Figure 6:
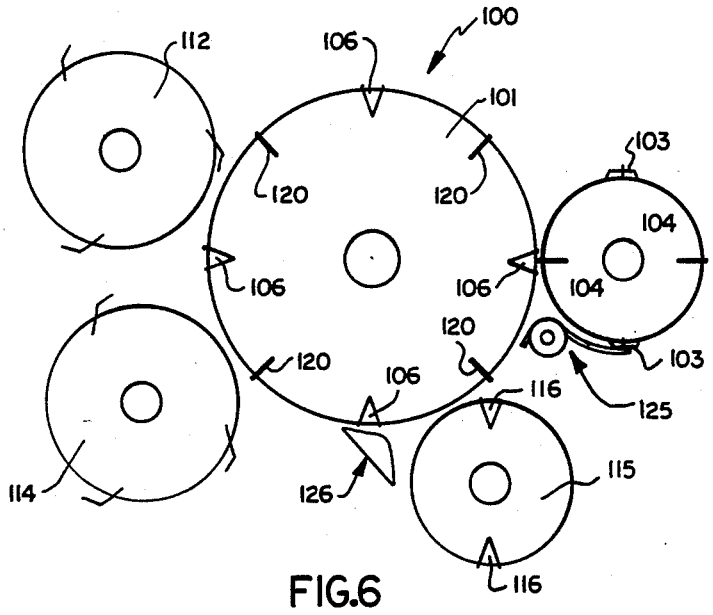
FIG. 6 is a schematic view of a different folder embodying the present invention.

A further embodiment of the present invention is illustrated in FIG. 6. In FIG. 6 the invention is shown as applied to a folder 100. The folder 100 has a pair of folding cylinders 101, 102. Web material is advanced into the nip between the rolls 101 and 102. The cylinder 102 has cutting knives 103 located at diametrically spaced points on the cylinder. The cutting knives 103 cooperate with the roll 101 to cut the web material as it is advanced through the nip. The cylinder 102 also has a pair of tucking blades 104. The tucking blades 104 cooperate with jaws 106 on the cylinder 101 and tuck the material into the jaws 106 to fold it. The cylinder 101 cooperates with an upper delivery cylinder 112 and a lower delivery cylinder 114. The cylinder 101 will deliver signatures to either the upper or lower delivery cylinder as is known. Also, the folder 100 includes a cylinder 115 which has jaws 116 thereon. The cylinder 115 is used in the situation where a second fold of the signature is desired. If the second fold of the signature is desired, tucker blades 120 are positioned on cylinder 101. The tucker blades 120 engage the signature which has already been folded the first time by the cylinders 101 and 102 and tuck that folded signature into one of the jaws 116 on the cylinder 115. This folds the signature a second time, and transfers the signature to the cylinder 115. The signature is then released from the cylinder 115 to a suitable delivery system (not shown).

The folder 100 has a vacuum guide system 125 similar to that described in the embodiment of FIG. 1 in the location at the nip between the cylinders 101, 102. In addition, a vacuum guide 126 is provided in the nip between the cylinders 101, 115. The vacuum guide 126 has a vacuum applied internally thereof and has a perforated housing. The vacuum guide applies vacuum in the nip area between the cylinders 101, 115. This vacuum attracts the folded signature to the guide 126 and controls the movement of the signature onto the cylinder 115 when the signature is reversed in its direction of rotation due to being folded into the jaws 116 by the tucker blades 120. Thus, it should be apparent that the embodiment of FIG. 6 utilizes vacuum to control a signature which is being folded between the cylinders 101, 115.

With the vacuum assembly illustrated, it is not necessary to provide any separate power drive for the roller and the only supply connection required is the vacuum connection to the fitting 71. Therefore, a very simple mechanism is provided to eliminate the tail whipping which has existed in the prior art and to provide a light drag or friction on the signature half as it feeds to the second cylinder 18 in a smooth, undamaging manner.

With the present invention, higher operating speeds can be achieved without tail whipping problems and an improved signature folding operation is provided.

Although the preferred embodiment of this invention has been shown and described, it should be understood that various modifications and rearrangements of the parts may be resorted to without departing from the scope of the invention as disclosed and claimed herein.

What is claimed is:

1. A signature folder comprising drive means to move at least a portion of a signature first in one direction and then in a reverse direction, guide means adjacent to said portion when it reverses direction, and vacuum means operable to create a vacuum between said guide means and signature portion operating to move said portion toward said guide means to prevent tail whipping when said portion reverses in direction, said guide means including a rotatable roll connected to a vacuum source, said roll being freely rotated by engagement with said signature portion.

2. A signature folder as set forth in claim 1, wherein said guide means includes a smooth stationary guide portion adjacent to said roll.

3. A signature folder as set forth in claim 2, wherein said drive means includes a pair of counter-rotating cylinders providing a throat therebetween through which said signature moves, and said guide meas are located adjacent to said throat.

4. A signature folder comprising a pair of counter-rotating cylinders providing means to grip a signature at spaced locations and causing a portion of the signature therebetween to move along the periphery of one cylinder in one direction and thereafter reverse directions and move along the periphery of the other cylinder, and vacuum means positioned adjacent said signature portion operable to prevent whipping thereof when said signature portion reverses direction and operating to guide said signature portion onto the periphery of said other cylinder, said vacuum means including a vacuum roll journaled for rotation between said cylinders, vacuum provided by said vacuum roll causing said signature portions to engage the surface of said vacuum roll, said vacuum roll guiding said signature portion as it moves in said reverse direction onto the periphery of said second cylinder, said vacuum roll being journaled on a vacuum tube connected to the interior of said roll for providing a vacuum therein, and smooth guide means being provided on each side of said vacuum roll to guide said signature portion into and out of engagement with said vacuum roll.

5. A signature folder as set forth in claim 4, wherein a shield is provided to concentrate vacuum along one side of said vacuum roll.

6. A signature folder as set forth in claim 5, wherein said shield is located inside of said roll and supported on said tube.

7. A method of preventing tail whipping of signatures when they reverse direction of movement comprising providing a guide along one side of said signature, providing a vacuum between said guide and signature for causing said signature to move toward said guide, and providing said guid with a freely rotating vacuum roll over which said signature moves.

* * * * *